US005329987A

United States Patent [19]

Andoh et al.

[11] Patent Number: 5,329,987

[45] Date of Patent: Jul. 19, 1994

[54] MOLTEN METAL POURING PIPE FOR PRESSURE-CASTING MACHINE

[75] Inventors: Mitsuru Andoh, Ena; Noriyoshi Naruse, Tokyo, both of Japan

[73] Assignees: Tokyo Yogyo Kabushiki Kaisha, Tokyo; Akechi Ceramics Co., Ltd., Gifu, both of Japan

[21] Appl. No.: 62,998

[22] Filed: May 17, 1993

[30] Foreign Application Priority Data

Jun. 22, 1992 [JP] Japan ..... 4-187672

[51] Int. Cl.[5] ..... B22D 17/06; B22D 41/50

[52] U.S. Cl. ..... 164/306; 164/337; 222/591; 222/603

[58] Field of Search ..... 164/306, 307, 309, 337; 222/591, 603, 606, 607

[56] References Cited

U.S. PATENT DOCUMENTS

| | | | |
|---|---|---|---|
| 3,395,840 | 8/1968 | Gardner | 222/591 |
| 3,673,039 | 6/1972 | Todd | 222/591 |
| 5,151,200 | 9/1992 | Stephansky | 222/606 |

FOREIGN PATENT DOCUMENTS

| | | | |
|---|---|---|---|
| 2064123 | 3/1972 | France | 222/591 |
| 2437898 | 6/1980 | France | 222/591 |
| 63-264256 | 11/1988 | Japan | 222/607 |

*Primary Examiner*—Paula A. Bradley
*Assistant Examiner*—Rex E. Pelto
*Attorney, Agent, or Firm*—Frishauf, Holtz, Goodman & Woodward

[57] ABSTRACT

A pressure-casting machine that contains a delivery system, which comprises: a molten metal pouring pipe made of a refractory, having a length of at least 4 m and an outside diameter of at least 350 mm, and arranged such that an upper end thereof is attached substantially vertically from below to an opening in a bottom wall of a mold for a pressure-casting machine, and a lower end thereof extends through a lid of a closed vessel arranged below the mold and is immersed into molten metal received in a ladle arranged in the closed vessel. The molten metal pouring pipe comprises at least two pipe sections connected to each other in series and in a liquid-tight manner by means of a threaded joint, tapered surfaces provided with screw threads of which have an inclination angle within a range of from 2.0° to 15.0° relative to the center axis of the molten metal pouring pipe.

9 Claims, 2 Drawing Sheets

MOLTEN METAL POURING PIPE FOR PRESSURE-CASTING MACHINE

BACKGROUND OF THE INVENTION

1. Field of the Invention

The present invention relates to a molten metal pouring pipe for a pressure-casting machine.

2. The Prior Art

A pressure-casting machine is known as an apparatus for casting molten metal.

A conventional pressure-casting machine 35 is described below with reference to FIG. 7.

FIG. 7 is a schematic vertical sectional view illustrating a conventional pressure-casting machine 35. As shown in FIG. 7, the conventional pressure-casting machine 35 comprises:

a mold 36 having an opening 36*b* in a bottom wall 36*a* thereof;

a closed vessel 37, arranged below said opening 36*b* of said mold 36, having a lid 37*a* and a compressed gas supply port 37*b;* a ladle 38 arranged in said closed vessel 37;

a molten metal pouring pipe A made of a refractory, having a sufficient length such that an upper end thereof is attached substantially vertically from below to said opening 36*b* in said bottom wall 36*a* of said mold 36, and a lower end thereof runs through said lid 37*a* of said closed vessel 37 and is immersed into molten metal received in said ladle 38 arranged in said closed vessel 37; and a compressed gas supply means (not shown) for supplying a compressed inert gas into said closed vessel 37 through said compressed gas supply port 37*b* of said closed vessel 37, so as to pour molten metal received in said ladle 37 into said mold 36 through said molten metal pouring pipe A.

According to the above-mentioned conventional pressure-casting machine 35, unlike the case of pouring molten metal into the mold from above, splash of molten metal never adheres onto an inner surface of the mold 36, and as a result, it is possible to manufacture a metal cast strand having a smooth surface. Since it is also possible to pour molten metal received in the ladle 38 into the mold 36 through the molten metal pouring pipe A without causing molten metal to be in contact with the open air, the oxidation of molten metal can substantially perfectly prevented, thus permitting the manufacture of a metal cast strand the chemical composition of which is very strictly controlled.

In the above-mentioned pressure-casting machine 35, there is a demand for a scaling up of the mold 36 and the ladle 38 with a view to improving the manufacturing efficiency, and along with this, it is inevitable to use a large-sized molten metal pouring pipe having a length of at least 4 m and an outside diameter of at least 350 mm.

A molten metal pouring pipe is used under very severe conditions. More specifically, not only the molten metal pouring pipe comes into contact with a high-temperature molten metal, but also molten metal having a very high pressure passes through a bore of the molten metal pouring pipe. The molten metal pouring pipe is therefore made of a refractory excellent in spalling resistance and having a high strength, for example, a refractory comprising aluminum oxide ($Al_2O_3$), carbon (C) and/or silicon oxide ($SiO_2$).

However because an article made of a refractory is limited in size, it is difficult to integrally form the above-mentioned large-sized molten metal pouring pipe with a refractory.

Under such circumstances, a large-sized molten metal pouring pipe for solving the above-mentioned problems is known (hereinafter referred to as the "prior art"). The molten metal pouring pipe B of the prior art for a pressure-casting machine is described below with reference to FIGS. 1 and 2.

FIG. 1 is a schematic front view illustrating a molten metal pouring pipe B of the prior art for a pressure-casting machine, and FIG. 2 is a schematic partial vertical sectional view illustrating the molten metal pouring pipe B of the prior art shown in FIG. 1.

As shown in FIGS. 1 and 2, the molten metal pouring pipe B of the prior art for the pressure-casting machine comprises:

two pipe sections 1 and 6 made of a refractory, connected to each other in series and in a liquid-tight manner by means of a threaded joint b, the threaded joint b comprising (i) a male screw 5 formed on a cylindrical outer surface of a lower end portion 3 of an upper pipe section 1 out of the two pipe sections 1 and 6, and (ii) a female screw 10, with which the male screw 5 of the upper pipe section 1 is to engage, formed on a cylindrical inner surface of an upper end portion 7 of a lower pipe section 6 out of the two pipe sections 1 and 6.

The upper pipe section 1 and the lower pipe section 6 are connected to each other in series and in a liquid-tight manner by causing the male screw 5 of the lower end portion 3 of the upper pipe section 1 to engage with the female screw 10 of the upper end portion 7 of the lower pipe section 6, whereby a bore 4 of the upper pipe section 1 and a bore 9 of the lower pipe section 6 communicate with each other. When causing the male screw 5 of the lower end portion 3 of the upper pipe section 1 to engage with the female screw 10 of the upper end portion 7 of the lower pipe section 6, it is possible to further improve liquid tightness at the junction between the upper pipe section 1 and the lower pipe section 6, i.e., at the threaded joint b, by applying a refractory mortar on the surfaces of the male screw 5 and the female screw 10.

According to the above-mentioned prior art, the large-sized molten metal pouring pipe B having a total length of at least 4 m and an outside diameter of at least 350 mm can be provided by connecting the two pipe sections 1 and 6 made of a refractory.

However, the molten metal pouring pipe B of the prior art has the following problems: When applying the molten metal pouring pipe B of the prior art to the pressure-casting machine to cast molten metal, the molten metal pouring pipe B is subjected to a considerable stress by molten metal passing therethrough, and particularly, stress is concentrated on a portion 3*a* near the starting point of the male screw 5 of the lower end portion 3 of the upper pipe section 1, and on a portion 7*a* near the starting point of the female screw 10 of the upper end portion 7 of the lower pipe section 6. Such concentration of stress may cause cracks in the above-mentioned portions 3*a* and 7*a* to cause the leakage of molten metal, and furthermore, the molten metal pouring pipe B may be broken at the junction between the upper pipe section 1 and the lower pipe section 6, i.e., at the threaded joint b, thus resulting in a stoppage of the casting operation.

Under such circumstances, there is a strong demand for the development of a molten metal pouring pipe for a pressure-casting machine, which increases the strength at the junction between the upper pipe section and the lower pipe section, thereby making it possible to continue a stable casting operation for a long period of time, but such a molten metal pouring pipe has not as yet been proposed.

SUMMARY OF THE INVENTION

An object of the present invention is therefore to provide a molten metal pouring pipe for a pressure-casting machine, which increases the strength at the junction between the upper pipe section and the lower pipe section, thereby making it possible to continue a stable casting operation for a long period of time.

In accordance with one of the features of the present invention, in a molten metal pouring pipe for a pressure-casting machine, which comprises:

a molten metal pouring pipe made of a refractory, having a sufficient length such that an upper end thereof is attached substantially vertically from below to an opening in a bottom wall of a mold for a pressure-casting machine, and a lower end thereof runs through a lid of a closed vessel arranged below said mold and is immersed into molten metal received in a ladle arranged in said closed vessel, said molten metal pouring pipe comprising at least two pipe sections connected to each other in series and in a liquid-tight manner;

there is provided the improvement wherein:

said at least two pipe sections are connected to each other by means of a threaded joint, tapered surfaces provided with screw threads of which have an inclination angle within a range of from 2.0° to 15° relative to the center axis of said molten metal pouring pipe.

DETAILED DESCRIPTION OF THE PREFERRED EMBODIMENTS

From the above-mentioned point of view, extensive studies were carried out to develop a molten metal pouring pipe for a pressure-casting machine, which increases strength at the junction between the upper pipe section and the lower pipe section, thereby making it possible to continue a stable casting operation for a long period of time.

As a result, the following findings were obtained: It is possible to provide a molten metal pouring pipe for a pressure-casting machine, which increases, in a molten metal pouring pipe for a pressure-casting machine, which comprises at least two pipe sections connected to each other in series and in a liquid-tight manner, strength at a portion in the junction between the upper pipe section and the lower pipe section, where stress tends to concentrate, thereby preventing the occurrence of cracks at the junction between the upper pipe section and the lower pipe section, and thereby making it possible to continue a stable casting operation for a long period of time, by connecting these at least two pipe sections to each other by means of a threaded joint, tapered surfaces provided with screw threads of which have an inclination angle within a range of from 2.0° to 15.0° relative to the center axis of the molten metal pouring pipe.

The present invention was made on the basis of the above-mentioned findings. Now, a molten metal pouring pipe of a first embodiment of the present invention for a pressure-casting machine, is described below in detail with reference to FIGS. 3 and 4.

Figure 3:
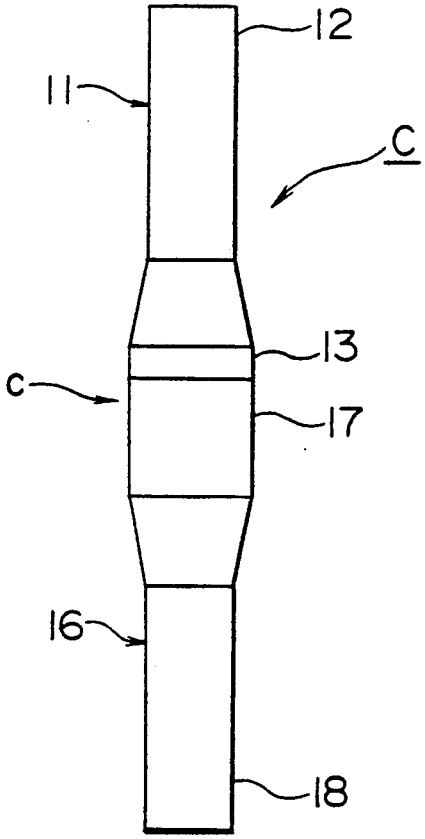
FIG. 3 is a schematic front view illustrating a molten metal pouring pipe of a first embodiment of the present invention for a pressure-casting machine.
Figure 4:
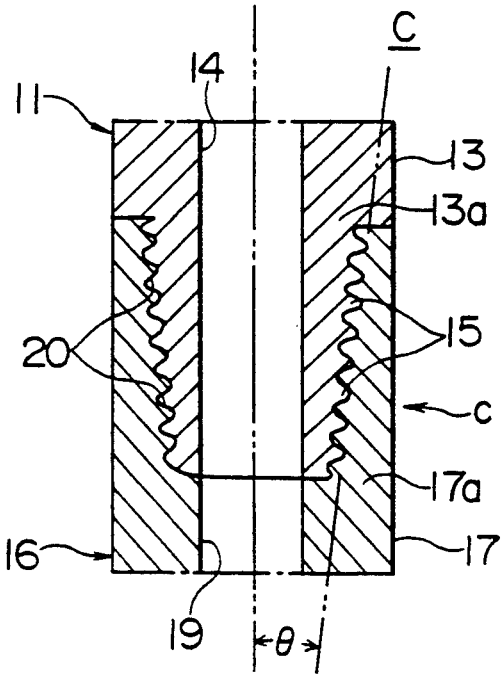
FIG. 4 is a schematic partial vertical sectional view illustrating the molten metal pouring pipe of the first embodiment of the present invention shown in FIG. 3.

FIG. 3 is a schematic front view illustrating a molten metal pouring pipe of a first embodiment of the present invention for a pressure-casting machine; and FIG. 4 is a schematic partial vertical sectional view illustrating the molten metal pouring pipe of the first embodiment of the present invention shown in FIG. 3.

As shown in FIGS. 3 and 4, the molten metal pouring pipe C of the first embodiment of the present invention comprises at least two pipe sections 11 and 16 connected to each other in series and in a liquid-tight manner by means of a threaded joint c.

These at least two pipe sections 11 and 16 are made of a refractory having a chemical composition comprising, for example, 27 wt. % carbon (C), 46 wt. % aluminium oxide ($Al_2O_3$), 24 wt. % silicon oxide ($SiO_2$) and 3 wt. % silicon carbide (SIC).

The threaded joint c for connecting these at least two pipe sections 11 and 16 to each other in series and in a liquid-tight manner comprises (i) a male screw 15 formed on a tapered outer surface coverging toward the tip of a lower end portion 13 of the upper pipe section 11 out of these at least two pipe sections 11 and 16, and (ii) a female screw 20, with which the male screw 15 of the upper pipe section 11 is to engage, formed on a tapered inner surface diverging toward the tip of an upper end portion 17 of the lower pipe section 16 out of these at least two pipe sections 11 and 16.

When each of the tapered outer surface provided with the male screw 15 of the lower end portion 13 of the upper pipe section 11, and the tapered inner surface provided with the female screw 20 of the upper end portion 17 of the lower pipe section 16 has an inclination angle "Θ" of under 2.0° relative to the center axis of the molten metal pouring pipe C, it is impossible to impart strength sufficient to withstand a large stress to a portion 13*a* near the starting point of the male screw 15 of the lower end portion 13 of the upper pipe section 11, and to a portion 17*a* near the starting point of the female screw 20 of the lower end portion 17 of the lower pipe section 16, and furthermore, it is impossible to prevent the concentration of stress on the above-mentioned portion 13*a* near the starting point of the male screw 15 and on the above-mentioned portion 17*a* near the starting point of the female screw 20. When the above-mentioned inclination angle "Θ" is over 15.0° relative to the center axis of the molten metal pouring pipe C, on the other hand, it is necessary to modify the shape of each of the male screw 15 and the female screw 20 into a special shape for obtaining a satisfactory state of engagement, thus resulting in an increase in the manufacturing cost, and making it difficult to ensure an excellent liquid tightness.

Therefore, the inclination angle "Θ" of each of the tapered outer surface provided with the male screw 15 of the lower end portion 13 of the upper pipe section. 11, and the tapered inner surface provided with the female screw 20 of the upper end portion 17 of the lower pipe section 16, relative to the center axis of the molten metal pouring pipe C, should be limited within a range of from 2.0° to 15.0°, and more preferably, within a range of from 4.0° to 8.0°.

With a pitch of each of the male screw 15 of the upper pipe section 11 and the female screw 20 of the lower pipe section 16 of under 10 mm, a strength sufficient to ensure a firm engagement between the upper pipe section 11 and the lower pipe section 16 cannot be obtained. It is difficult, on the other hand, to efficiently form the male screw 15 and the female screw 20 having a pitch of over 85 mm respectively on the tapered outer surface converging toward the tip of the lower end portion 13 of the upper pipe section 11 and on the tapered inner surface deiverging toward the tip of the upper end portion 17 of the lower pipe section 16.

Therefore, the pitch of each of the male screw 15 of the upper pipe section 11 and the female screw 20 of the lower pipe section 16, should preferably be limited within a range of from 10 to 80 mm, and more preferably, within a range of from 25 to 65 mm.

The upper pipe section 11 and the lower pipe section 16 are connected to each other in series and in a liquid-tight manner by causing the male screw 15 of the lower end portion 13 of the upper pipe section 11 to engage with the female screw 20 of the upper end portion 17 of the lower pipe section 16, whereby a bore 14 of the upper pipe section 11 and a bore 19 of the lower pipe section 16 are communicated with each other. When causing the male screw 15 of the lower end portion 13 of the upper pipe section 11 to engage with the female screw 20 of the upper end portion 17 of the lower pipe section 16, it is possible to further improve liquid-tightness at the junction between the upper pipe section 11 and the lower pipe section 16, i.e., at the threaded joint c, by applying a refractory mortar onto the surfaces of the male screw 15 and the female screw 20.

Now, the usage of the molten metal pouring pipe C of the first embodiment of the present invention is described.

Figure 7:
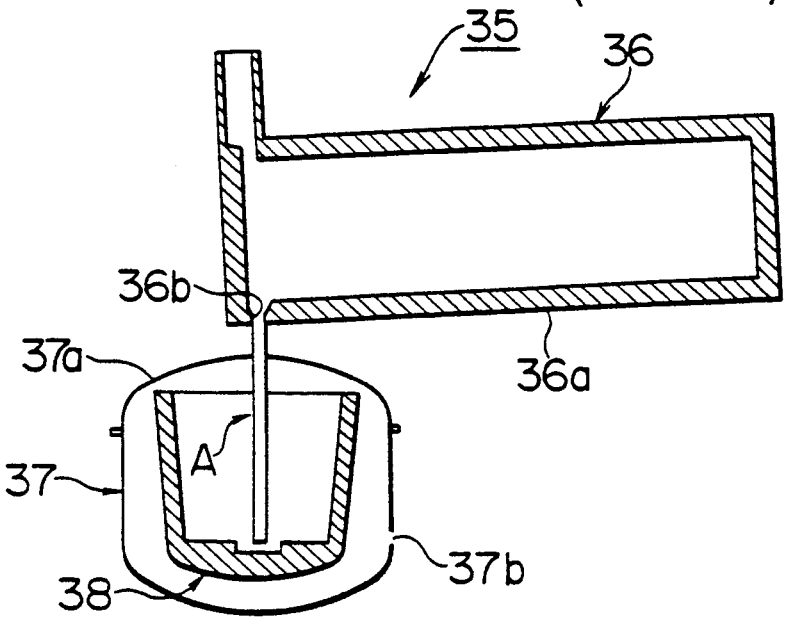
FIG. 7 (PRIOR ART)
FIG. 7 is a schematic vertical sectional view illustrating a conventional pressure-casting machine.

An upper end 12 of the upper pipe section 11 of the molten metal pouring pipe C of the first embodiment of the present invention is, as in the conventional molten metal pouring pipe A shown in FIG. 7, attached substantially vertically from below to the opening **36*b* in the bottom wall 36*a* of the mold 36 for the pressure-casting machine 35. In this state, the lower end 18 of the lower pipe section 16 of the molten metal pouring pipe C runs through the lid 37*a* of the closed vessel 37 arranged below the mold 36 and is immersed into molten metal received in the ladle 38 arranged in the closed vessel 37. By supplying a compressed gas such as an inert gas into the closed vessel 37 from the compressed gas supply means (not shown) through the compressed gas supply port 37*b* of the closed vessel 37, molten metal received in the ladle 38 arranged in the closed vessel 37 is poured into the mold 36** through the molten metal pouring pipe C under the effect of the compressed gas thus supplied.

As described above, the molten metal pouring pipe C is subjected to a considerable stress by molten metal passing therethrough upon casting molten metal, and particularly, the lower end portion 13 of the upper pipe section 11 and the upper end portion 17 of the lower pipe section 16 are subjected to a particularly large stress. In the molten metal pouring pipe C of the present invention, however, these at least two pipe sections 11 and 16 are connected to each other by means of the threaded joint c. Furthermore, the tapered outer surface provided with the male screw 15 and converging toward the tip of the lower end portion 13 of the upper pipe section 11, and the tapered inner surface provided with the female screw 20 and diverging toward the tip of the upper end portion 17 of the lower pipe section 16, have an inclination angle within a range of from 2.0° to 15.0° relative to the center axis of the molten metal pouring pipe C. It is therefore possible to increase strength of the portion **13*a* near the starting point of the male screw 15 of the lower end portion 13 of the upper pipe section 11 and the portion 17*a* near the starting point of the female screw 20 of the upper end portion 17 of the lower pipe section 16 by increasing the thickness thereof, to prevent the concentration of stress on the portion 13*a* near the starting point of the male screw 15 and the portion 17*a* near the starting point of the female screw 20, and thus to prevent the occurrence of cracks in the junction between the upper section 11 and the lower pipe section 16**, i.e., at the threaded joint c.

In the above-mentioned molten metal pouring pipe C of the first embodiment of the present invention, the threaded joint c for connecting these at least two pipe sections 11 and 16 to each other in series and in a liquid-tight manner comprises, as described above, (i) the male screw 15 formed on the tapered outer surface converging toward the tip of the lower end portion 13 of the upper pipe section 11 out of these at least two pipe sections 11 and 16, and (ii) the female screw 20, with which the male screw 15 of the upper pipe section 11 is to engage, formed on the tapered inner surface diverging toward the tip of the upper end portion 17 of the lower pipe section 16 out of these at least two pipe sections 11 and 16. However, the threaded joint c for connecting these at least two pipe sections 11 and 16 to each other in series and in a liquid-tight manner may comprise (i) a female screw formed on a tapered inner surface diverging toward the tip of a lower end portion 13 of the upper pipe section 11 out of these at least two pipe sections 11 and 16, and (ii) a male screw, with which the female screw of the pipe section 11 is to engage, formed on a tapered outer surface converging toward the tip of an upper end portion 17 of the lower pipe section 16 out of these at least two pipe sections 11 and 16.

Now, a molten metal pouring pipe of a second embodiment of the present invention for a pressure-casting machine, is described below with reference to FIGS. 5 and 6.

Figure 5:
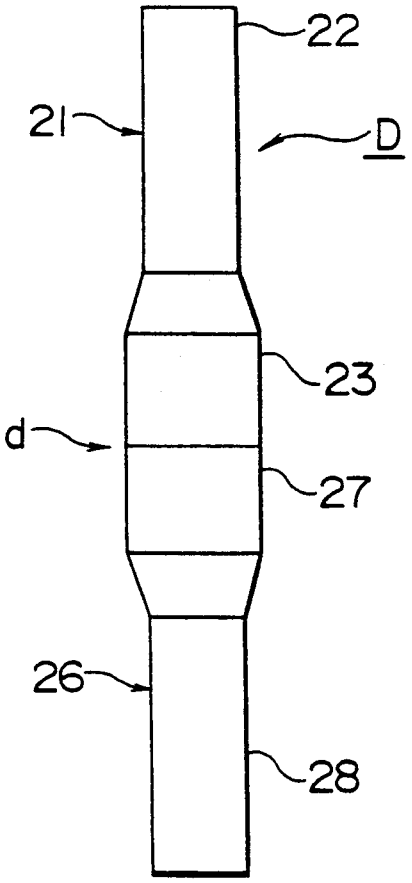
FIG. 5 is a schematic front view illustrating a molten metal pouring pipe of a second embodiment of the present invention for a pressure-casting machine.
Figure 6:
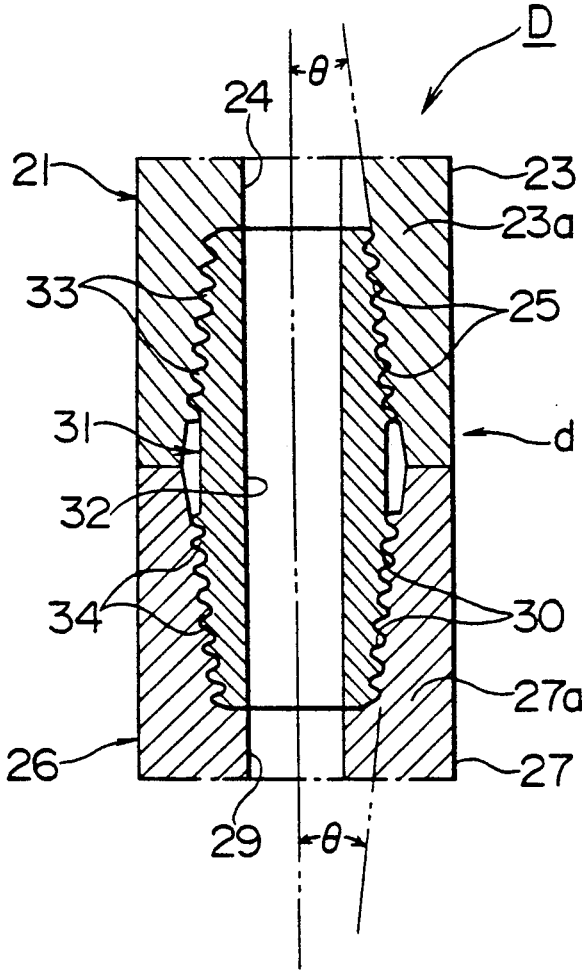
FIG. 6 is a schematic partial vertical sectional view illustrating the molten metal pouring pipe of the second embodiment of the present invention shown in FIG. 5.

FIG. 5 is a schematic front view illustrating a molten metal pouring pipe of a second embodiment of the present invention for a pressure-casting machine; and FIG. 6 is a schematic partial vertical sectional view illustrating the molten metal pouring pipe of the second embodiment of the present invention shown in FIG. 5.

As shown in FIGS. 5 and 6, the molten metal pouring pipe D of the second embodiment of the present invention comprises at least two pipe sections 21 and 26 connected to each other in series and in a liquid-tight manner by means of a threaded joint d.

These at least two pipe sections 21 and 26 are made of the same refractory as that in the above-mentioned molten metal pouring pipe C of the first embodiment of the present invention.

The threaded joint d for connecting these at least two pipe sections 21 and 26 to each other in series and in a liquid-tight manner comprises (i) a female screw 25 formed on a tapered inner surface diverging toward the tip of a lower end portion 23 of the upper pipe section 21 out of these at least two pipe sections 21 and 26, (ii) a female screw 30 formed on a tapered inner surface diverging toward the tip of an upper end portion 27 of the lower pipe section 26 out of these at least two pipe sections 21 and 26, and (iii) a nipple 31 made of a refractory, having a male screw 33, with which the female screw 25 of the upper pipe section 21 is to engage, formed on a tapered outer surface converging toward the tip of an upper end portion thereof, and another male screw 34, with which the female screw 30 of the lower pipe section 26 is to engage, formed on a tapered outer surface converging toward the tip of a lower end portion thereof.

When each of the tapered inner surface provided with the female screw 25 of the lower end portion 23 of the upper pipe section 21, and the tapered outer surface provided with the male screw 33 of the upper end portion of the nipple 31, has an inclination angle "Θ" of under 2.0° relative to the center axis of the molten metal pouring pipe D, it is impossible to impart strength sufficient to withstand a large stress to a portion 23*a* near the starting point of the female screw 25 of the lower end portion 23 of the upper pipe section 21, and furthermore, it is impossible to prevent the concentration of stress on the above-mentioned portion 23*a* near the starting point of the female screw 25. When the above-mentioned inclination angle "Θ" is over 15.0° relative to the center axis of the molten metal pouring pipe D, on the other hand, it is necessary to modify the shape of each of the female screw 25 and the male screw 33 into a special shape for obtaining a satisfactory state of engagement, thus leading to an increase in the manufacturing cost, and making it difficult to ensure an excellent liquid tightness.

Therefore, the inclination angle "Θ" of each of the tapered inner surface provided with the female screw 25 of the lower end portion 23 of the upper pipe section 21, and the tapered outer surface provided with the male screw 33 of the upper end portion of the nipple 31, relative to the center axis of the molten metal pouring pipe D, should be limited within a range of from 2.0° to 15.0° and more preferably, within a range of from 4.0° to 8.0°.

For the same reason as described above, the inclination angle "Θ" of each of the tapered inner surface provided with the female screw 30 of the upper end portion 27 of the lower pipe section 26, and the tapered outer surface provided with the other male screw 34 of the lower end portion of the nipple 31, relative to the center axis of the molten metal pouring pipe D, should be limited within a range of from 2.0° to 15.0°, and more preferably, within a range of from 4.0° to 8.0°.

The pitch of each of the female screw 25 of the upper pipe section 21, the female screw 30 of the lower pipe section 26, and the male screw 33 and the other male screw 34 of the nipple 31, which are to engage with these female screws 25 and 26, respectively, should preferably be limited within a range of from 10 to 85 mm, and more preferably, within a range of from 25 to 65 mm. The reasons therefor are the same as those given in the description of the molten metal pouring pipe C of the first embodiment of the present invention.

By causing the male screw 33 of the upper end portion of the nipple 31 to engage with the female screw 25 of the lower end portion 23 of the upper pipe section 21, and by causing the other male screw 34 of the lower end portion of the nipple 31 to engage with the female screw 30 of the upper end portion 27 of the lower pipe section 26, the upper pipe section 21 and the lower pipe section 26 are connected to each other in series and in a liquid-tight manner, whereby a bore 24 of the upper pipe section 21 and a bore 29 of the lower pipe section 26 are communicated with each other through a bore 32 of the nipple 31. When causing the male screw 33 of the upper end portion of the nipple 31 to engage with the female screw 25 of the lower end portion 23 of the upper pipe section 21, and causing the other male screw 34 of the lower end portion of the nipple 31 to engage with the female screw 30 of the upper end portion 27 of the lower pipe section 26, it is possible to further improve liquid-tightness at the junction between the upper pipe section 21 and the lower pipe section 26, i.e., at the threaded joint d by applying a refractory mortar onto the surface of each of the male screws 33 and 34 and the female screws 25 and 30.

The molten metal pouring pipe D of the second embodiment of the present invention is used in the same manner as that in the above-mentioned molten metal pouring pipe C of the first embodiment of the present invention, and the same effects as those in the molten metal pouring pipe C of the first embodiment are made available. Furthermore, since the upper pipe section 21 can have the same shape as that of the lower pipe section 26 in the molten metal pouring pipe D of the second embodiment of the present invention, it is possible to reduce the manufacturing cost.

Now, the molten metal pouring pipe of the present invention for a pressure-casting machine is described further in detail by means of an example, while comparing with an example for comparison.

EXAMPLE

The molten metal pouring pipe C of the first embodiment of the present invention shown in FIGS. 3 and 4 was prepared. More particularly, two pipe sections 11 and 16 were separately formed of a refractory having a chemical composition comprising 27 wt. % carbon (C), 46 wt. % aluminum oxide ($Al_2O_3$), 24 wt. % silicon oxide ($SiO_2$) and 3 wt. % silicon carbide (SIC). The upper pipe section 11 out of the two pipe sections 11 and 16 had the male screw 15 formed on the tapered outer surface converging toward the tip of the lower end portion 13 of the upper pipe section 11, and the lower pipe section 16 out of the two pipe sections 11 and 16 had, on the other hand, the female screw 20 formed on the tapered inner surface diverging toward the tip of the upper end portion 17 of the upper pipe section 16.

Then, the upper pipe section 11 and the lower pipe section 16 were connected to each other in series and in a liquid-tight manner by causing the male screw 15 of the lower end portion 13 of the upper pipe section 11 to engage with the female screw 20 of the upper end portion 17 of the lower pipe section 16, whereby the bore 14 of the upper pipe section 11 and the bore 19 of the lower pipe section 16 were communicated with each other, to prepare the molten metal pouring pipe C for a pressure-casting machine. When causing the male screw 15 of the lower end portion 13 of the upper pipe section 11 to engage with the female screw 20 of the upper end portion 17 of the lower pipe section 16, a refractory mortar was applied onto the surfaces of the male screw 15 and the female screw 20 to further improve liquid-tightness at the junction between the upper pipe section 11 and the lower pipe section 16, i.e., at the threaded joint c.

In accordance with the above-mentioned manner, samples of the molten metal pouring pipes C within the scope of the present invention for a pressure-casting machine (hereinafter referred to as the "samples of the invention") Nos. 1 to 9 were prepared, which samples were different from each other within the scope of the present invention in the inclination angle "Θ" of the tapered outer surface of the lower end portion 13 of the upper pipe section 11 and the tapered inner surface of the upper end portion 17 of the lower pipe section 16 relative to the center axis of the molten metal pouring pipe C, as well as in the pitch of the male screw 15 formed on the tapered outer surface of the lower end portion 13 of the upper pipe section 11 and the female screw 20 formed on the tapered inner surface of the upper end portion 17 of the lower pipe section 16.

The dimensions of various portions in each of the samples of the invention Nos. 1 to 9 are shown in Table 1.

cal inner surface of the upper end portion 7 of the lower pipe section 6.

Then, the upper pipe section 1 and the lower pipe section 6 were connected to each other in series and in a liquid-tight manner in the same manner as in the samples of the invention Nos. 1 to 9, thereby preparing samples of the molten metal pouring pipes B outside the scope of the present invention for a pressure-casting machine (hereinafter referred to as the "samples for comparison") Nos. 1 and 2.

The dimensions of various portions in each of the samples for comparison Nos. 1 and 2 are shown also in Table 1.

For comparison purposes, furthermore, samples of molten metal pouring pipes outside the scope of the present invention for a pressure-casting machine (hereinafter referred to as the "samples for comparison") Nos. 3 to 5 were prepared. More specifically, each of the samples for comparison Nos. 3 to 5 comprised two pipe sections separately formed of a refractory having the same chemical composition as that of the samples of the invention Nos. 1 to 9. The upper pipe section out of the two pipe sections had a male screw formed on a tapered outer surface of the lower end portion of the upper pipe section, as in the upper pipe section 11 in the samples of the invention Nos. 1 to 9. The lower pipe section out of the two pipe sections had, on the other hand, a female screw formed on a tapered inner surface of the upper end portion of the lower pipe section, as in the lower pipe section 16 in the samples of the invention No. 1 to 9. The tapered outer surface of the lower end portion of the upper pipe section and the tapered inner

TABLE 1

| No. | Total length (mm) | Threaded joint: Outer diameter (mm) | Inner diameter (mm) | Length of portion provided with screw threads (mm) | Inclination angle of surface provided with screw threads | Pitch of screw threads (mm) | Thickness of portion near starting point of screw threads (mm) | Number of cycle for casting steel strands | Average value of number of steel strands cast by repeating cycle for casting |
|---|---|---|---|---|---|---|---|---|---|
| Sample of the invention | | | | | | | | | |
| 1 | 4,100 | 350 | 120 | 300 | 2.0° | 10 | 52.0 | 3 | 11.2 |
| 2 | 4,100 | 350 | 120 | 300 | 2.0° | 25 | 44.5 | 3 | 11.7 |
| 3 | 4,100 | 350 | 120 | 300 | 8.0° | 35 | 62.5 | 4 | 15.6 |
| 4 | 4,100 | 350 | 120 | 300 | 8.0° | 45 | 57.5 | 4 | 15.5 |
| 5 | 4,100 | 350 | 120 | 300 | 10.0° | 45 | 62.5 | 4 | 15.6 |
| 6 | 4,100 | 350 | 120 | 300 | 12.0° | 25 | 77.5 | 4 | 14.5 |
| 7 | 4,100 | 400 | 120 | 300 | 12.0° | 85 | 47.5 | 4 | 12.2 |
| 8 | 4,100 | 400 | 120 | 300 | 15.0° | 25 | 85.5 | 4 | 13.5 |
| 9 | 4,100 | 400 | 120 | 300 | 15.0° | 85 | 55.5 | 4 | 13.8 |
| Sample for comparison | | | | | | | | | |
| 1 | 4,100 | 350 | 120 | 300 | 0° | 9 | 48.0 | 3 | 9.2 |
| 2 | 4,100 | 350 | 120 | 300 | 0° | 35 | 41.5 | 3 | 10.4 |
| 3 | 4,100 | 350 | 120 | 300 | 1.0° | 8 | 51.0 | 3 | 9.5 |
| 4 | 4,100 | 400 | 120 | 300 | 16.0° | 95 | 53.0 | 3 | 9.9 |
| 5 | 4,100 | 400 | 120 | 300 | 17.5° | 86 | 55.0 | 3 | 9.4 |

Figure 1:
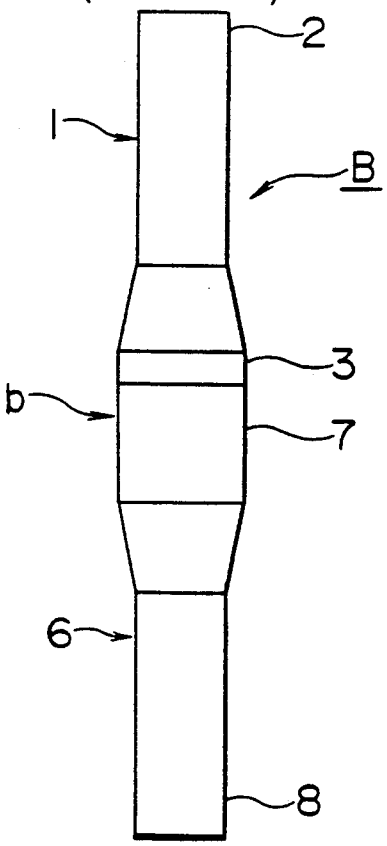
FIG. 1 (PRIOR ART)
FIG. 1 is a schematic front view illustrating a molten metal pouring pipe of the prior art for a pressure-casting machine.
Figure 2:
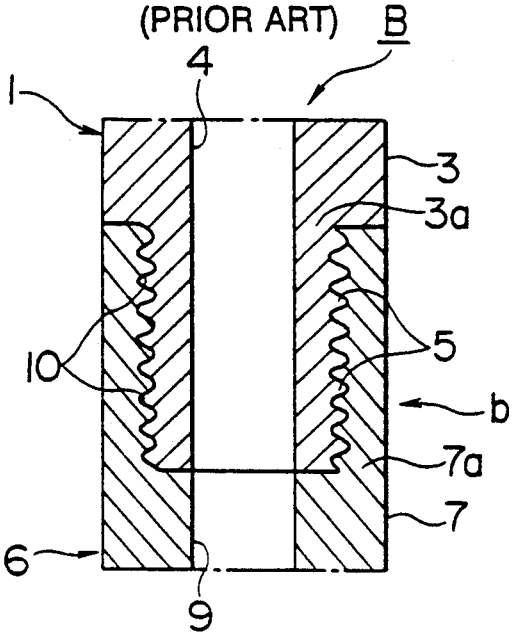
FIG. 2 (PRIOR ART)
FIG. 2 is a schematic partial vertical sectional view illustrating the molten metal pouring pipe of the prior art shown in FIG. 1.

For comparison purposes, the molten metal pouring pipe B outside the scope of the present invention for a pressure-casting machine as shown into FIGS. 1 and 2 was prepared. More specifically, two pipe sections 1 and 6 were separately formed of a refractory having the same chemical composition as that of the samples of the invention Nos. 1 to 9. The upper pipe section 1 out of the two pipe sections 1 and 6 had the male screw 5 formed on the cylindrical outer surface of the lower end portion 3 of the upper pipe section 1, and the lower pipe section 6 out of the two pipe sections 1 and 6 had, on the other hand, the female screw 10 formed on the cylindrisurface of the upper end portion of the lower pipe section, had an inclination angle of under 2.0° or over 15.0° outside the scope of the present invention relative to the center axis of the molten metal pouring pipe. In each of the samples for comparison Nos. 3 to 5, the upper pipe section and the lower pipe section were connected to each other in series and in a liquid-tight manner in the same manner as in the samples of the invention Nos. 1 to 9.

The dimensions of various portions in each of the samples for comparison Nos. 3 to 5 are shown also in Table 1.

The pressure casting of molten steel was conducted by applying each of the samples of the invention Nos. 1 to 9 and the samples for comparison Nos. 1 to 5, to a known pressure-casting machine to investigate durability for each sample.

The above-mentioned known pressure-casting machine comprised a carriage travellable on a pair of rails, a closed vessel mounted on the carriage, a ladle arranged in the closed vessel, and five molds arranged above the closed vessel in parallel with each other at prescribed intervals in the travelling direction of the carriage. The ladle had a capacity of 75 tons of molten steel. The upper end portion of a sample of the molten metal pouring pipe was secured to a lid of the closed vessel so that the lower end of the sample ran through the lid of the closed vessel and was immersed into molten steel received in the ladle.

Then, the carriage mounting the closed vessel in which the ladle was arranged was moved to below a first mold out of the five molds, and the upper end of the sample was connected to an opening of a bottom wall of the first mold. Then, a compressed inert gas was supplied into the closed vessel from a compressed gas supply means through a compressed gas supply port of the closed vessel to pour molten steel received in the ladle arranged in the closed vessel into the first mold through the sample under the effect of the compressed inert gas thus supplied. After the completion of pouring of molten steel into the first mold, supply of the compressed inert gas into the closed vessel was discontinued, and the connection between the opening of the bottom wall of the first mold and the upper end of the sample was released. Then, the carriage mounting the closed vessel in which the ladle was arranged was moved to below a second mold out of the five molds, and the upper end of the sample was connected to an opening of a bottom wall of the second mold. Then, again in the same manner as described above, the compressed inert gas was supplied into the closed vessel to pour molten steel received in the ladle arranged in the closed vessel into the second mold through the sample. After the completion of pouring of molten steel into the second mold, supply of the compressed inert gas into the closed vessel was discontinued, and the connection between the opening of the bottom wall of the second mold and the upper end of the sample was released. Thus, molten steel was poured sequentially into these five mold in the same manner as described above. After the solidification of molten steel poured into the individual molds, cast steel strands were taken out from the molds, whereby a plurality of steel strands were cast from 75 tons of molten steel received in the single ladle. The pouring operation of molten steel into the mold was immediately discontinued when cracks were produced during the pouring operation of molten steel at the junction between the upper pipe section and the lower pipe section of the sample, i.e., the threaded joint, and as a result, any abnormality was observed in the pouring operation of molten steel.

After the completion of the above-mentioned first cycle for casting a plurality of steel strands from 75 tons of molten steel for the single ladle, a second cycle comprising the same steps as in the first cycle was carried out. Since a certain period of time was required for the preparation of a new heat of molten steel between the first cycle and the second cycle, the sample used in the first cycle was cooled. The sample was therefore previously heated prior to the start of the second cycle. A plurality of cycles for casting a plurality of steel strands from 75 tons of molten steel of the single ladle were thus carried out.

For each of a plurality of the same samples, the above-mentioned pressure casting was conducted, and for each of the same samples, an average value of the number of steel strands cast by repeating the cycle for casting a plurality of steel strands, was calculated. For each of the samples of the invention Nos. 1 to 9 and the samples for comparison Nos. 1 to 5, a number of repetitions of the cycle for casting a plurality of steel strands, and an average value of the number of the steel strands cast by repeating the above-mentioned cycle are shown also in Table 1.

As is clear from Table 1, in the samples of the invention Nos. 1 to 9, the average values of the number of steel strands cast by repeating the cycle for casting a plurality of steel strands were so high as within a range of from 11.2 to 15.6, demonstrating that all the samples of the invention Nos. 1 to 9 had an excellent durability.

In the samples for comparison Nos. 1 to 5, in contrast, the average values of the number of steel strands cast by repeating the cycle for casting a plurality of steel strands were so low as within a range of from 9.2 to 10.4, suggesting that all the samples for comparison Nos. 1 to 5 were inferior in durability.

Samples of the molten metal pouring pipe D of the second embodiment of the present invention as shown in FIGS. 5 and 6 were prepared, and by using these samples within the scope of the present invention, the same pressure casting as mentioned above was carried out, and substantially the same results as those mentioned above for the samples of the invention Nos. 1 to 9 were obtained.

According to the present invention, as described above in detail, it is possible to provide a molten metal pouring pipe for a pressure-casting machine, which increases the strength at the junction between the upper pipe section and the lower pipe section, thereby making it possible to continue a stable casting operation for a long period of time, thus providing many industrially useful effects.

What is claimed is:

1. In a pressure-casting machine that contains a molten metal delivery system, which comprises:

a mold;

a closed vessel arranged below said mold;

a molten metal pouring pipe made of a refractory, said molten metal pouring pipe having a center axis, a length of at least 4 m, and an outside diameter of at least 350 mm;

an upper end of said molten metal pouring pipe being attached substantially vertically from below to an opening in a bottom wall of said mold of the pressure-casting machine;

a lower end of said molten metal pouring pipe extending through a lid of said closed vessel arranged below said mold, and said lower end being immersed into molten metal received in a ladle arranged in said closed vessel; and said molten metal pouring pipe comprising at least two pipe sections connected to each other in series and in a liquid-tight manner;

the improvement wherein:

said at least two pipe sections have mutually engageable screw threaded sections for connecting said pipe sections to each other by means of a threaded joint formed by engagement of screw threads of said mutually engageable screw threaded sections, said screw threaded sections each having tapered surfaces provided with said screw threads, said tapered surfaces each having an inclination angle within a range of from 2.0° to 15.0° relative to the center axis of said molten metal pouring pipe, whereby molten metal is moved upwardly through said pouring pipe, under pressure, with liquid tightness.

2. A pressure-casting machine as claimed in claim 1, wherein said screw threads of said screw threaded sections of said threaded joint comprise:

(i) a male screw thread formed on a tapered outer surface converging toward a tip of a lower end portion of an upper pipe section of said at least two pipe sections, and (ii) a female screw thread, with which said male screw thread of said upper pipe section is engageable, said female screw thread being formed on a tapered inner surface diverging toward a tip of an upper end portion of a lower pipe section of said at least two pipe sections.

3. A pressure-casting machine as claimed in claim 1, wherein said screw threads of said screw threaded sections of said threaded joint comprise:

(i) a female screw thread formed on a tapered inner surface diverging toward a tip of a lower end portion of an upper pipe section of said at least two pipe sections, and (ii) a male screw thread, with which said female screw thread of said upper pipe section is engageable, said male screw thread being formed on a tapered outer surface converging toward a tip of an upper end portion of a lower pipe section of said at least two pipe sections.

4. A pressure-casting machine as claimed in claim 1, wherein said screw threads of said screw threaded sections of said threaded joint comprise:

(i) a female screw thread formed on a tapered inner surface diverging toward a tip of a lower end portion of an upper pipe section of said at least two pipe sections, and (ii) a female screw thread formed on a tapered inner surface diverging toward a tip of a lower end portion of an upper pipe section of said at least two pipe sections, and (iii) a nipple made of a refractory, said nipple having a male screw thread, with which said female screw thread of said upper pipe section is engageable, formed on a tapered outer surface converging toward a tip of an upper end portion thereof, and another male screw thread, with which said female screw thread of said lower pipe section is engageable, formed on a tapered outer surface converging toward a tip of a lower end portion thereof.

5. A pressure-casting machine as claimed in any one of claims 1 to 4, wherein:

said tapered surfaces of said screw threaded sections of said threaded joint have an inclination angle within a range of from 4.0° to 8.0° relative to the center axis of said molten metal pouring pipe.

6. A pressure-casting machine as claimed in any one of claims 1 to 4 wherein:

said screw threads of said screw threaded sections of said threaded joint have a patch within a range of from 10 to 85 mm.

7. A pressure-casting machine as claimed in claim 5, wherein:

said screw threads of said screw threaded sections of said threaded joint have a pitch within a range of from 10 to 85 mm.

8. A pressure-casting machine as claimed in any one of claims 1 to 4 wherein:

said screw threads of said screw threaded sections of said threaded joint have a patch within a range of 25 to 65 mm.

9. A pressure-casting machine as claimed in any one of claim 5, wherein:

said screw threads of said screw threaded sections of said threaded joint have a patch within a range of 25 to 65 mm.

* * * * *

UNITED STATES PATENT AND TRADEMARK OFFICE

CERTIFICATE OF CORRECTION

PATENT NO. :5,329,987

DATED :July 19, 1994

INVENTOR(S) :ANDOH et al

It is certified that error appears in the above-identified patent and that said Letters Patent is hereby corrected as shown below:

Column 14, line 2 (claim 4), delete "and"

Column 14, line 4 (claim 4),
change "a lower" to --an upper--

Column 14, line 5 (claim 4),
change "an upper" to --a lower--

Column 14, line 25 (claim 6),
change "patch" to --pitch--

Column 14, line 35 (claim 8),
change "patch" to --pitch--

Column 14, lines 37-38 (claim 9),
delete "any one of"

Column 14, line 40 (claim 9),
change "patch" to --pitch--

Signed and Sealed this

Tenth Day of January, 1995

*Attest:*

Bruce Lehman

BRUCE LEHMAN

*Attesting Officer*

*Commissioner of Patents and Trademarks*